United States Patent [19]

Wiesenfeld et al.

[11] Patent Number: 5,054,146

[45] Date of Patent: Oct. 8, 1991

[54] ANCHOR BOLT

[75] Inventors: David Wiesenfeld, Givatiam, Israel; Moshe Josef, Johannesburg, South Africa

[73] Assignee: Videx-Wire Products (PTY) Limited, Johannesburg, South Africa

[21] Appl. No.: 446,537

[22] Filed: Dec. 6, 1989

[30] Foreign Application Priority Data

| | | | |
|---|---|---|---|
| Dec. 8, 1988 | [ZA] | South Africa | 88/9191 |
| Mar. 15, 1989 | [ZA] | South Africa | 89/1954 |
| Mar. 15, 1989 | [ZA] | South Africa | 89/1955 |

[51] Int. Cl.[5] ..... B21C 37/00; E21D 21/00

[52] U.S. Cl. ..... 10/27 E; 405/259; 405/261; 411/379

[58] Field of Search ..... 405/259, 261, 260; 72/191, 198, 185, 187, 194; 411/379, 411; 10/27 FS, 27 S

[56] References Cited

U.S. PATENT DOCUMENTS

| | | | |
|---|---|---|---|
| 333,888 | 1/1886 | Perry | 72/191 |
| 699,678 | 5/1902 | Gridley | 411/379 |
| 1,052,282 | 2/1913 | Schmitt | 411/379 |
| 1,163,981 | 12/1915 | Dodds | 411/379 |
| 1,188,914 | 6/1916 | Dodds | 411/379 |
| 1,271,151 | 7/1918 | Frauenheim | 411/379 |
| 1,712,286 | 5/1929 | Witherow et al. | 72/198 X |
| 2,552,364 | 5/1951 | Bradbury | 72/198 X |
| 2,821,727 | 2/1958 | Corckran | 72/191 X |
| 3,742,747 | 7/1973 | Fukushima et al. | 72/191 X |
| 3,780,556 | 12/1973 | Johnson | 72/191 X |
| 4,531,861 | 7/1985 | Kash | 405/259 X |
| 4,619,559 | 10/1986 | Norris | 405/259 |

FOREIGN PATENT DOCUMENTS

| | | | |
|---|---|---|---|
| 0004001 | 1/1980 | Japan | 72/198 |
| 808865 | 2/1959 | United Kingdom | 72/191 |

*Primary Examiner*—Dennis L. Taylor

*Attorney, Agent, or Firm*—Nixon & Vanderhye

[57] ABSTRACT

A method of making an anchor bolt with a thread on a section thereof comprising the steps of providing a metal bar (1) of circular or near circular cross-section having a diameter which is substantially equal to the pitch diameter of the thread to be provided thereon, extruding the bar along a selected section (A) thereof to reduce its cross-section, forming a series of lateral protrusions (3) on the selected section of the bar, straightening the bar, and, forming a thread (5) with the said pitch diameter on a further selected section of the bar.

8 Claims, 7 Drawing Sheets

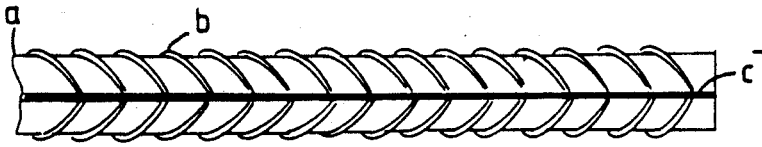
FIG A
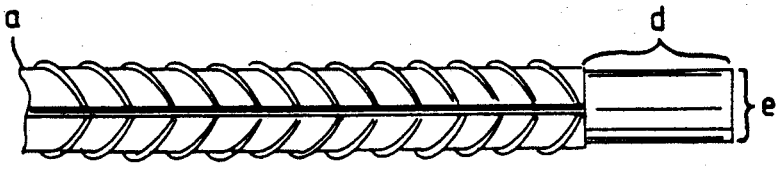
FIG B
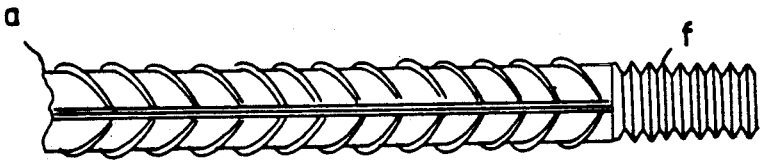
FIG C
PRIOR ART

ANCHOR BOLT

FIELD OF THE INVENTION

This invention relates to an anchor bolt and more particularly, but not exclusively, to an anchor bolt for use in underground mining operations.

BACKGROUND OF THE INVENTION

Many different kinds of anchor bolts or rock bolts are used to secure rock strata underground. One kind comprises a length of reinforcing bar having ribs along its length which enhance the anchoring ability of the bolt. In the case where a resin with a catalyst is used to secure the bolt in a hole in the rock matrix, the bolt is initially rotated in the hole to mix the resin and the ribs also serve the purpose of assisting the mixing of the resin. However, known ribbed formations on rock bolts do not protrude sufficiently to provide good mixing of the resin.

The end of the bolt which is intended to project from the rock face has a rolled thread thereon which receives a nut used to tension the bolt. The bar from which such a prior art rock bolt is made is manufactured in a steel mill and is supplied with the ribs formed on the whole length of the bar. In order to provide the rolled thread on the bolt, the bolt has to be machined to remove the ribs on a section thereof and to ensure that such section has a circular cross-section. Such a machining operation adds to the cost of the prior art rock bolt.

In certain mining operations, particularly coal mining, temporary anchor bolts are used to secure the mined face. In the case of coal mining these bolts may be made from glass reinforced resin rods. When the face carrying the rods is cut the rods are simply broken up in the cutting process. There are several disadvantages attaching to the use of resin rods. Firstly, they are relatively expensive. Also, in the case where the rod is embedded in a resin mix within a hole in the coal face, the rod, being smooth, provides poor anchoring and is also unsuitable for initial mixing of the resin in the hole.

It is an object of the invention to lessen the problems associated with prior art anchor bolts or rock bolts and to reduce the cost of their manufacture.

SUMMARY OF THE INVENTION

In this specification, the term "pitch diameter", in relation to a straight thread, means the diameter of an imaginary co-axial cylinder, the surface of which passes through the thread profiles at such points as to make the width of the groove equal to one half of the basic pitch of the thread. On a perfect thread this occurs at the point where the width of the thread and groove are equal.

The term "bar" when used in this specification includes a pipe and a bar with an axial bore.

According to the invention, a method of making an anchor bolt with a thread on a section thereof, comprises the steps of providing a metal bar of circular or near circular cross-section having a diameter which is substantially equal to the pitch diameter of the thread to be provided thereon, extruding the bar along a selected section thereof to reduce its cross-section, forming a series of lateral protrusions on the selected section of the bar, straightening the bar, and, forming a thread with the said pitch diameter on a further selected section of the bar.

In a preferred form the bar is indented during extrusion thereof by forming a longitudinal groove therein. The longitudinal groove is preferably one of a pair of diametrically opposed longitudinal grooves formed in the bar during extrusion. Each groove may be interrupted by spaced semi-circular lands formed therein.

As will become evident in the subsequent description, this method results in a saving of material without reducing the yield or tensile load-carrying ability of the anchor bolt.

The extrusion of the bar and the formation of lateral protrusions thereon may be effected simultaneously by passing the bar between a pair of rolls in the cold condition of the bar.

In a further form of the invention, when the bar passes between the rolls, at least one zone of weakness is formed in the bar where it will first sever upon the application of a predetermined axial or lateral force upon the bar.

The bar may be extruded along substantially the entire length of the bar, save for the selected section on which the thread is formed.

The thread formed on the further selected section of the bar may be formed by cold rolling.

The bar may be straightened in two planes, preferably by passing it sequentially through two sets of opposed, staggered rollers.

The invention also provides apparatus for making an anchor bolt from a metal bar of circular cross-section comprising a pair of rolls, means for driving the rolls about their axes in opposite directions, each roll having a groove formed in its surface facing the other roll, the grooves defining an opening for receiving the bar in lengthwise fashion, the opening being of lesser area than the starting cross-sectional area of the metal bar so that the bar is extruded along its length to reduce its cross-section when the bar is passed between the rolls, each roll having spaced formations provided along its periphery which align periodically with similar formations on the other roll in the nip of the rolls when they are rotated in opposite directions, the spaced formations being adapted to form lateral deformations on the bar when it is passed between the rolls.

Preferably, at least one of the rolls has indenting means in its groove for indenting the bar along the length thereof when it is passed between the rolls. The indenting means are preferably provided in the groove of each roll and preferably comprise an annular formation provided in each groove. Each annular formation is preferably notched along its periphery.

The apparatus may include means for straightening the bar after it has been passed between the rolls.

The spaced formations on the rolls may comprise pins mounted on the rolls. Each pin may have a central annular rebate therein which co-operates with a retaining bolt in the roll to prevent withdrawal of the pin but to permit rotation of the pin about its own axis.

The means for straightening the bar may comprise two sets of opposed staggered rollers through which the bar is passed, the rollers of one set being located at right angles to those of the other set.

According to a further aspect of the invention there is provided an anchor bolt comprising a metal bar having a first section with a circular or near circular cross-section of a selected uniform diameter, the bar having a thread with a selected pitch diameter formed on the first section thereof located at at least one end of the bar, the bar having a second section with a cross-section less than that of the first section, the bar being indented along the second section thereof and having a series of spaced lateral protrusions pinched from the bar on the same section of the bar.

The bar is preferably indented by the provision of a pair of longitudinal grooves therein.

In one form the cross-section of the bar at the smallest diameter of the thread on the first section of the bar equals the smallest cross-section of the bar in the second section thereof.

The invention also extends to an anchor bolt when made according to the method of the invention described above.

BRIEF DESCRIPTION OF THE DRAWINGS

Preferred embodiments of the invention will now be described by way of example with reference to the accompanying drawings in which.

FIGS. A to C illustrate a prior art method of making a rock bolt.

DESCRIPTION OF PREFERRED EMBODIMENTS OF THE INVENTION

With reference to FIGS. A to C, a prior art steel bar (a) is provided, and is cut to the required length. The bar (a) carries a series of diametrically opposed inclined ribs (b) separated by a pair of longitudinal ribs (c) of which only one is shown. The ribs (b), (c) are formed conventionally by hot rolling during manufacture of the bar (a) in a steel mill. The next step in making the prior art rock bolt is to machine or shave the bar (a) as shown in FIG. B along a section (d) of its length to remove the ribs (b), (c) and to ensure that the section (d) has a circular cross-section of diamater (e). Thereafter a thread (f) is rolled on to the section (d) of the bar as shown in FIG. C to complete the rock bolt. It will be appreciated that the tensile strength of the bolt is determined by the minimum diameter of the thread (f) of the bolt, since that is its smallest diameter.

Figure 1A:
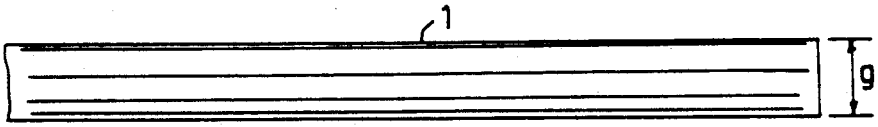
FIGS. 1*a* to 1*c* illustrate steps in making a rock bolt according to the method of the invention.
Figure 1B:
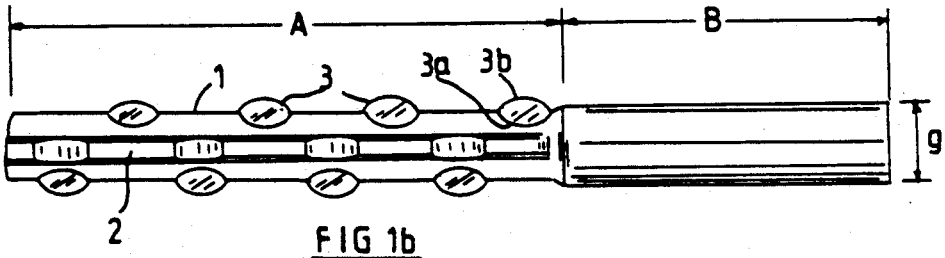
Figure 1C:
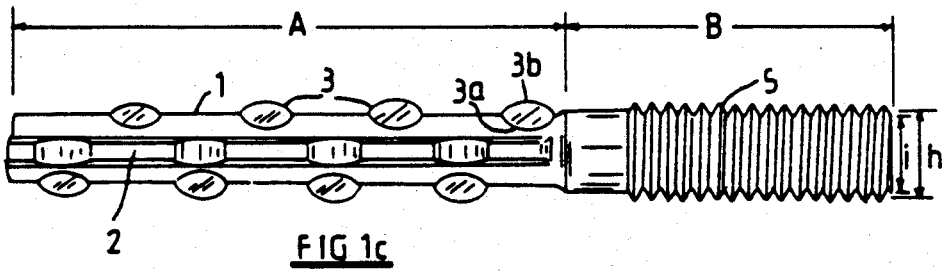
Figure 1D:
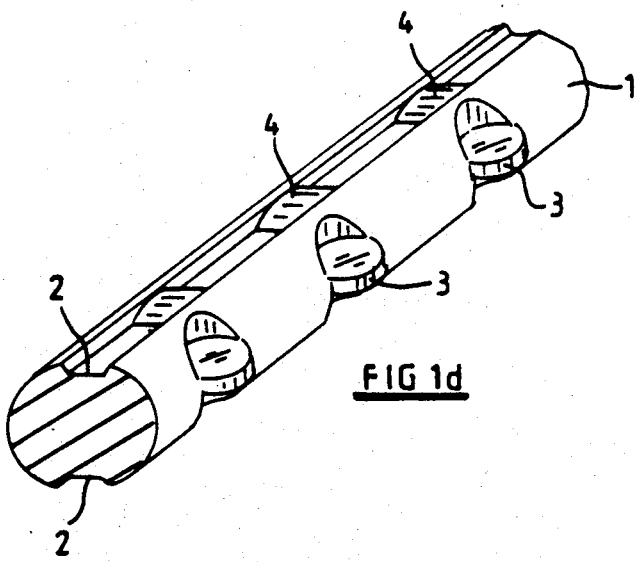
FIG. 1*d* is a perspective view of part of a rock bolt of the invention.

FIGS. 1*a* to 1*c* illustrate steps in making a rock bolt according to the method of the invention. The rock bolt is formed from a carbon steel bar 1 of circular or near circular cross-section having a diameter g. Carbon steel is used because of its ability to deform relatively easily. The first step in making a rock bolt from the bar 1 is to extrude the bar 1 along a section A thereof to reduce its cross-section and in so doing to indent the bar by forming a pair of diametrically opposed longitudinal grooves 2 therein. Simultaneously with the extrusion of the bar a series of lateral protrusions in the form of flat lobes 3 are formed in the section A of the bar. The method of doing so will be more fully described hereunder.

In the form shown, each groove 2 is interrupted by spaced semi-circular lands 4 formed therein.

A section B of the bar which is to be threaded is left free of lobes 3 (FIG. 1*b*). After the bar has been extruded along the section A and after it has been passed through a straightening station to straighten it, a thread 5 is cold rolled on to the section B of the bar (FIG. 1*c*). The pitch diameter of the thread 5 is indicated by letter h, which is substantially equal to the starting diameter g, and the minimum diameter of the thread 5 is indicated by letter i. In the embodiment of the invention shown, the minimum diameter i of the thread 5 is chosen so that the cross-section of the bar at this point approximately equals the smallest cross-section of the bar in the section A of the bar.

In this embodiment of the invention, as most clearly shown in FIGS. 1*b* and 1*c,* the lobes 3 are arranged in staggered formation along the length of the bar 1. The sides 3*a,* 3*b* of each lobe respectively nearest and furthest the axis of the bar are arcuate so that each lobe has a generally elliptical outline in plan view.

In an alternative method the thread 4 may first be rolled onto the section B of the bar after which the bar may be extruded along the section A. Thereafter the bar may be straightened.

The manner of extruding the bar 1 along the section A and of forming the lobes 3 on the bar and the apparatus used for this purpose is illustrated in FIGS. 2 to 6. The apparatus, indicated generally by numeral 6, comprises a frame 7 having a pair of rolls 8, 8' mounted thereon for rotation about horizontal axes (FIGS. 2*a,* 2*b*) . An electric motor 10 is provided to drive the rolls about their respective axes in opposite directions. The drive is effected through a multiple groove pulley 11.

Figure 3A:
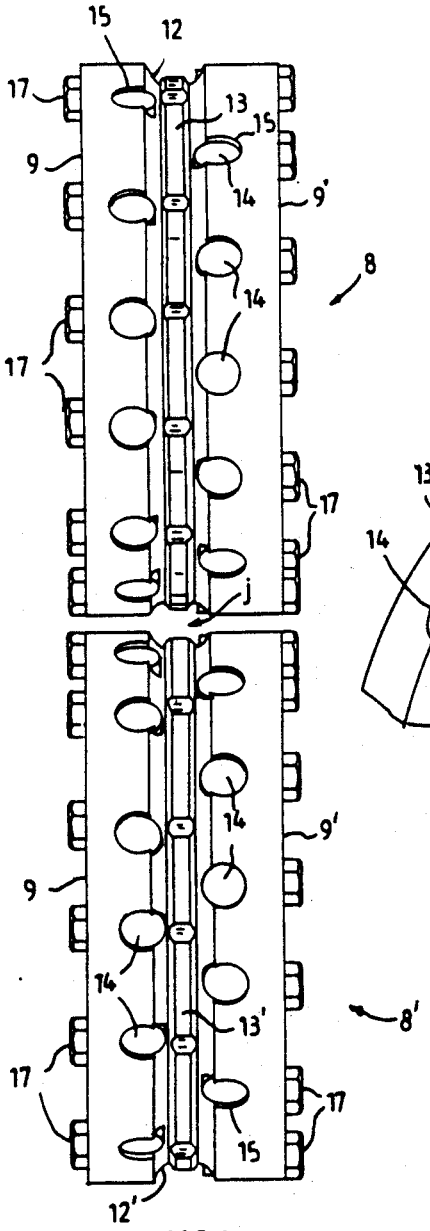
FIG. 3*a* is an end elevation of a pair of rolls used in the apparatus of FIGS. 2*a* and 2*b;*
Figure 3B:
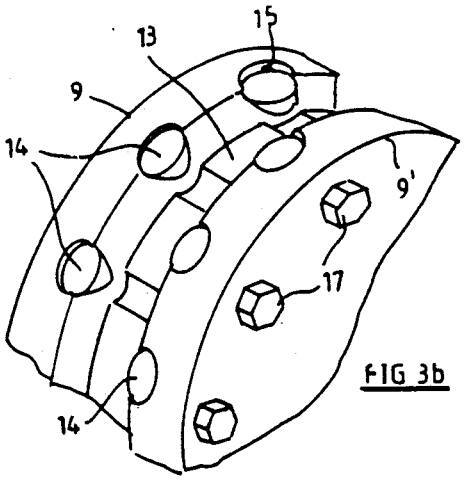
FIG. 3*b* is a perspective view of part of one of the rolls of FIG. 3*a;*
Figure 3C:
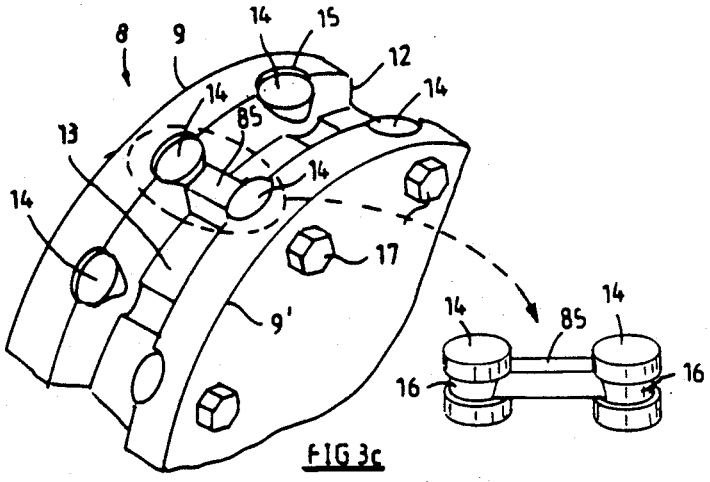
FIG. 3*c* is a similar view of part of one of the rolls, containing a further modification.
Figure 3D:
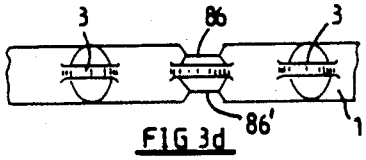
FIG. 3*d* shows part of an anchor bolt made with the roll of FIG. 3*c;*

The rolls 8, 8' have grooves 12, 12' formed respectively in their edges facing one another, which grooves define an opening j for receiving the bar 1 in lengthwise fashion (FIG. 3*a*). Each of the rolls 8, 8' is made of three parts, consisting of a pair of outer plates 9, 9' sandwiching a disc 13, 13' between them (FIGS. 3*a,* 3*b*). The peripheral free ends of the discs 13, 13' project into the grooves 12, 12' of the rolls and provide means for indenting the bar 1 longitudinally when it passes between the rolls. The discs 13, 13' are notched at spaced positions along their peripheries to enhance their grip on the bar when it passes between the rolls and to form the lands 4 in the grooves 2 of the bar 1.

The opening j is of a lesser area than the starting cross-sectional area of the bar 1, so that the bar is extruded along its length to reduce its cross-section when the bar is passed between the rolls 8, 8'.

Each roll has a plurality of pins 14 mounted in holes 15 along the periphery of the roll. The pins 14, which are sunk in the holes 15 so as not to protrude beyond the peripheral edges of the plates 9, 9', are arranged in such a manner that corresponding pins on the rolls periodically align in the nip of the rolls when they are rotated. The pins 14 are preferably of circular cross-section but they may be of any required cross-section depending on the shape of the lobes 3 required on the bar 1.

Figure 3E:
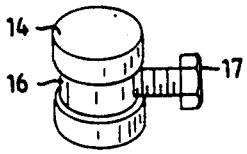
FIG. 3*e* is a perspective view of a pin used in the rolls of FIGS. 3*a* to 3*c;*

The pins 14 are a relatively free fit in their respective holes 15 in the rolls to enable them to rotate about their own axes when the bar 1 passes between the rolls. Each pin 14 has a central annular rebate 16 therein which co-operates with a retaining bolt 17 mounted in the outer plate 9 or 9' of the roll to prevent the pin from falling out of its hole 15 but at the same time permitting it to rotate in its hole (FIG. 3*e*).

Figure 2A:
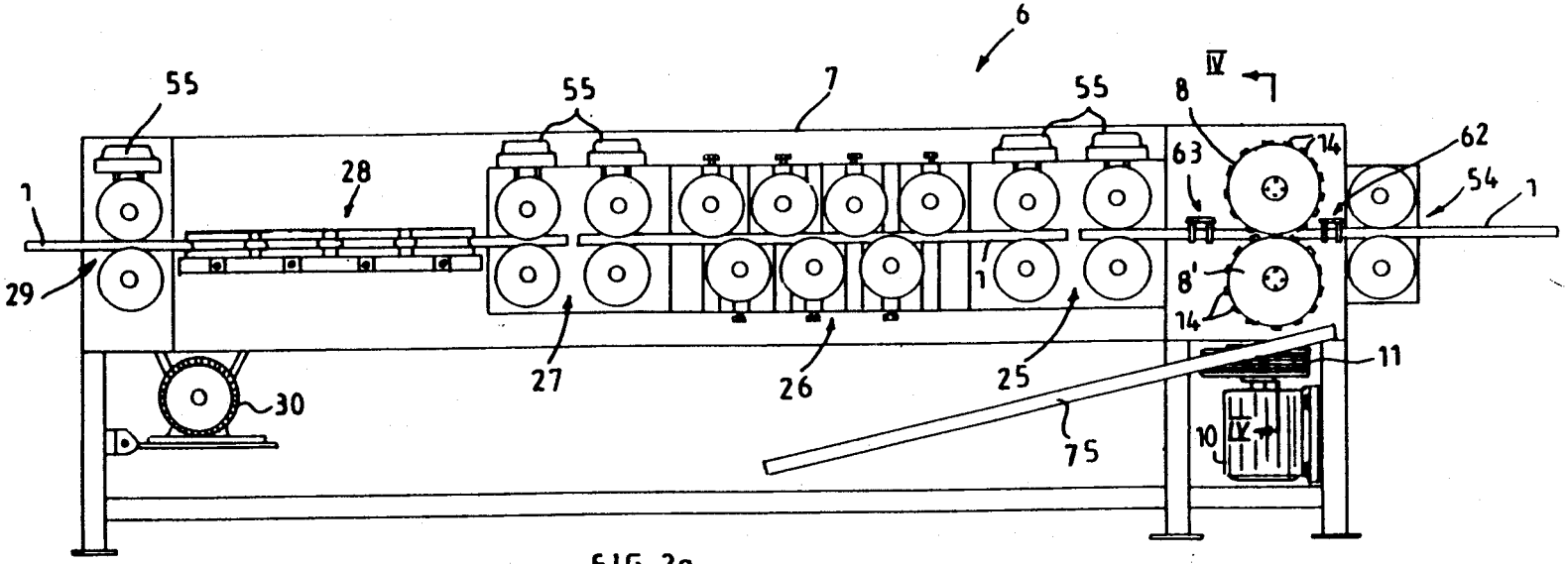
FIGS. 2*a* and 2*b* are a schematic elevation and plan view respectively of apparatus used to carry out the method of the invention.
Figure 2B:
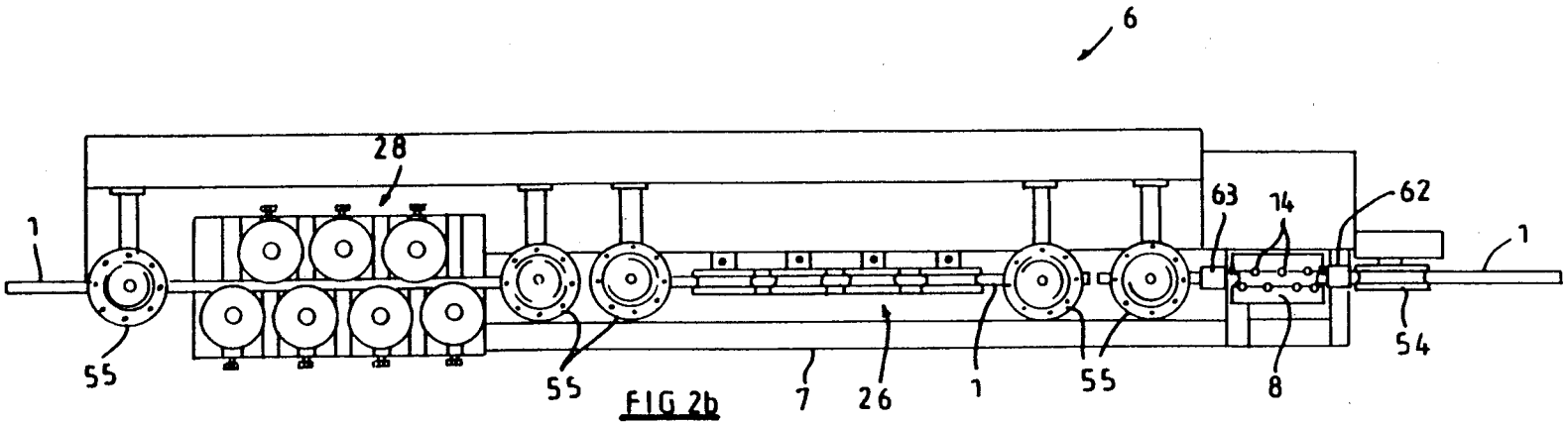

Alongside the rolls 8, 8' there is a set of driven rollers 25 followed by a set of straightening rollers 26 which are arranged in opposed, staggered formation (FIGS. 2*a*, 2*b*). Alongside the straightening rollers 26 there is a further set of driven rollers 27. The sets of rollers 25, 26, 27 are mounted for rotation about horizontal axes. Alongside the driven rollers 27 there is a further set of straightening rollers 28 arranged in opposed, staggered formation and mounted for rotation about vertical axes. Finally, alongside the straightening rollers 28 there is a set of driven rollers 29 mounted for rotation about horizontal axes. The sets of driven rollers 25, 27, 29 are driven by an electric motor 30.

Figure 4:
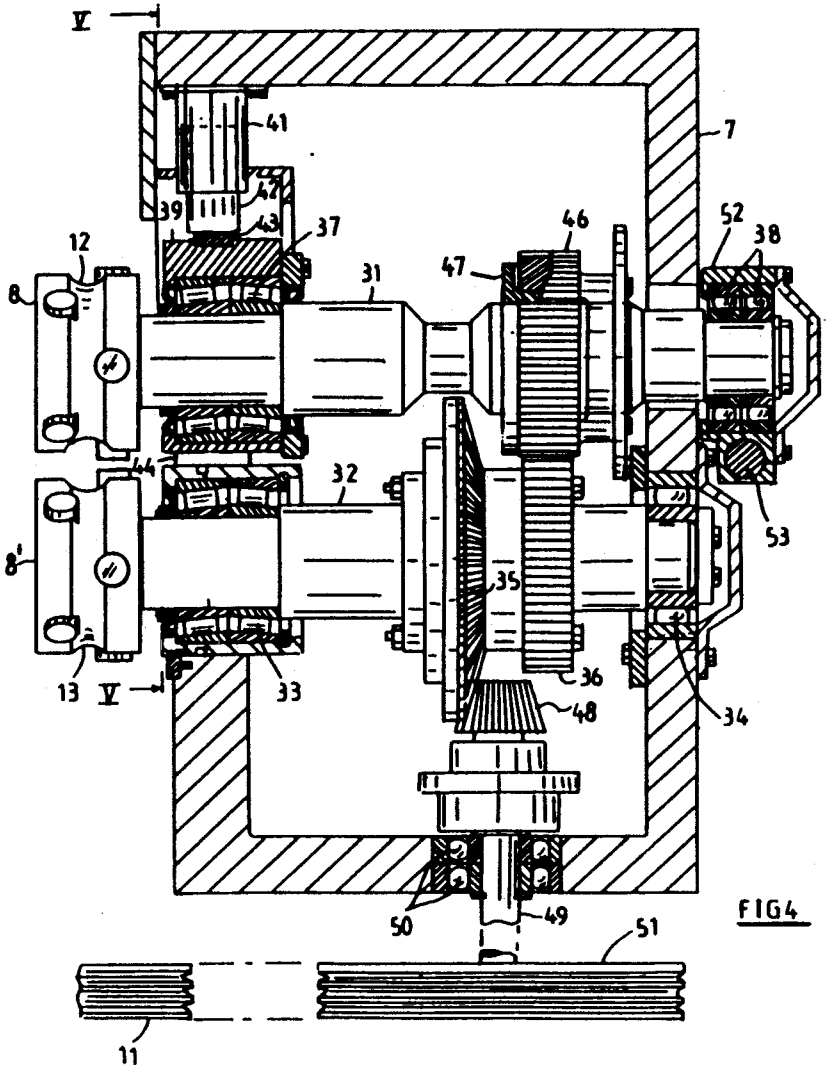
FIG. 4 is a section of part of the apparatus of FIG. 2*a* taken along lines IV—IV in FIG. 2*a,* with parts thereof omitted for clarity.

In this embodiment of the invention the rolls 8, 8' are mounted on shafts 31, 32 respectively (FIG. 4). The shaft 32 is rotatably mounted on a self-aligning roller bearing 33 at its forward end and a on a ball bearing 34 at its inner end. The bearings 33, 34 are mounted on the frame 7 of the apparatus 6. Between its ends the shaft 32 carries a crown gear 35 and a spur gear 36. The shaft 31 is rotatably mounted in a self-aligning roller bearing 37 at its forward end and on a set of ball bearings 38 at its inner end.

Figure 5:
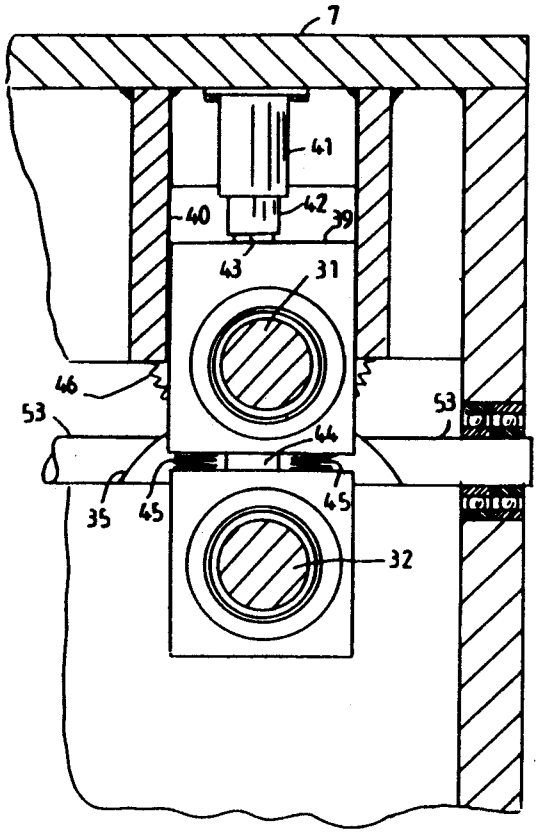
FIG. 5 is a section of part of the apparatus shown in FIG. 4 taken along line V—V.

The roller bearing 37 is contained in a housing 39 which is movable in a slide 40 mounted on the frame 7 (FIG. 5). A hydraulic ram 41 is located above the housing 39 of the roller bearing 37 and has a piston 42 which acts against a hardened metal footpiece 43 mounted on the housing 39. At its lower end the housing 39 of the roller bearing 37 bears on a hardened metal spacer 44. On each side of the spacer 44 a coil spring 45 is provided which tends to urge the housing upwardly. Between its ends the shaft 31 carries a spur gear 46 which meshes with the spur gear 36 on the shaft 32. The spur gear 46 is mounted on the shaft 31 by means of cotters 47 to permit the setting between the gears 36, 46 and hence the setting between the rolls 8, 8' to be adjusted. The crown gear 35 meshes with a pinion 48 carried on a shaft 49 mounted on a set of roller bearings 50 and connected to a fly wheel 51. The fly wheel 51 is belt driven from the pulley 11 of the electric motor 10.

The set of roller bearings 38 located at the inner end of the shaft 31 is housed in a housing 52 which is mounted on a pivot 53. With this arrangement the shaft 31 and roll 8 are displaceable upwardly and downwardly about the pivot 53. When the hydraulic ram 41 is activated the piston 42 bears on the footpiece 43 on the housing 39 and forces the shaft 31 downwardly until the lower end of the housing 39 seats on the metal spacer 44. The metal spacer 44 therefore serves to determine the gap in the nip of the rolls 8, 8' and in order to create different gaps spacers 44 of different thickness may be used. When the hydraulic pressure in the ram 41 is released the springs 45 acting against the housing 39 displace the shaft 31 upwardly and hence displace the roll 8 away from the roll 8'.

The pinion 48 serves to drive the shaft 32, and hence the roll 8', through the crown gear 35. At the same time the spur gear 36 drives the shaft 31, and hence the roll 8, in an opposite direction through the spur gear 46. The gears 36, 46 are selected so that when the roll 8 is displaced upwardly away from the roll 8' the gears 36, 46 remain meshed and the rolls 8, 8' continue rotating in opposite directions.

In use, the bar 1 is cut to a discrete length and is fed through a pair of guide rollers 54 into the nip of the rolls 8, 8' while the rolls are driven in opposite directions. As the bar 1 passes through the nip of the rolls it is extruded to reduce its cross-section and in so doing the peripheral free edges of the discs 13, 13' in the grooves 12, 12' in the rolls form the longitudinal grooves 2 in the bar. At the same time the pins 14 periodically pinch the metal of the bar 1 to form the lobes 3 thereon. This can be achieved in a single pass of the bar 1 through the rolls 8, 8' in the cold condition of the bar. (Owing to the size of the drawings, the lobes 3 are not shown on the bar 1 in FIGS. 2*a* and 2*b*.) The rolls 8, 8' are controlled to ensure that the grooves 2 and lobes 3 are formed only on the section A of the bar. In this embodiment of the invention this is achieved by means of a pair of sensing devices 62, 63 mounted ahead of and behind the rolls 8, 8'.

Figure 6D:
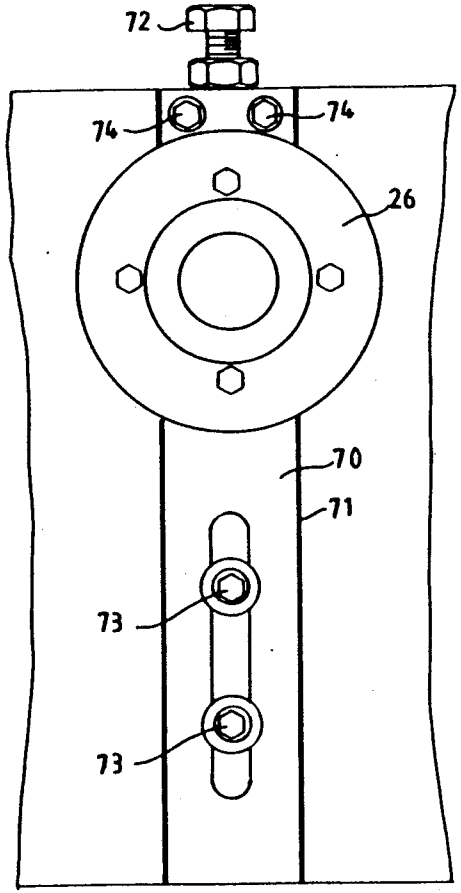
FIGS. 6*a* to 6*d* are enlarged views of parts of the apparatus of FIGS. 2*a* and 2*b.
Figure 6B:
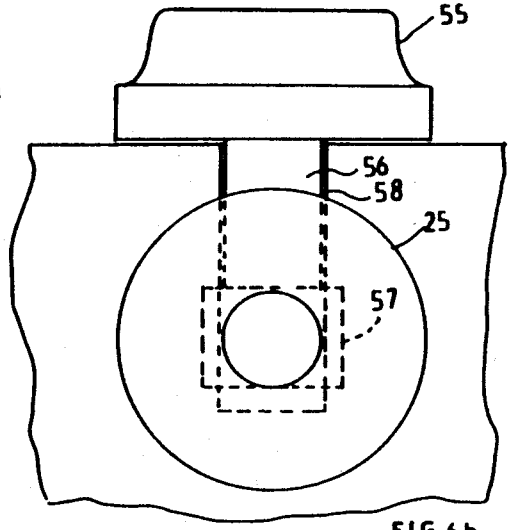
Figure 6C:
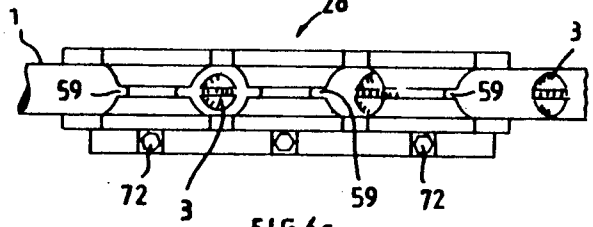
Figure 6A:
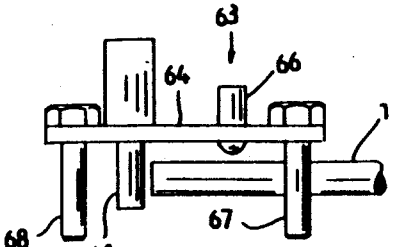
Figure 7A:
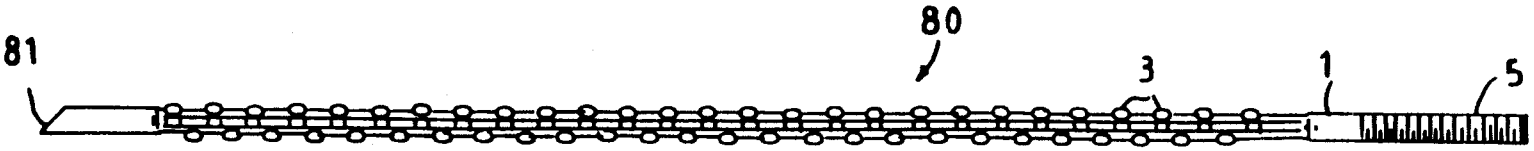
* and FIGS. 7*a* and 7*b* show two different kinds of rock bolts made according to the invention.
Figure 7B:
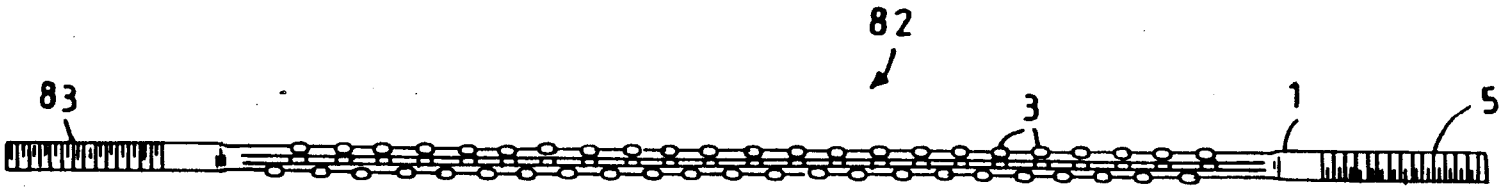

The sensing device 63 mounted behind the rolls 8, 8' comprises a support 64 carrying a retractable stop member 65 and a sensor 66 (FIG. 6*a*). The support 64 also carries two pairs of dependent guides 67, 68 through which the bar 1 moves. The sensing device 62 mounted ahead of the rolls 8, 8' may be the same a the sensing device 63 but the retractable stop member 65 may be omitted.

With the rolls 8, 8' in an open position, the bar 1 is advanced freely therebetween. As the leading end of the bar enters the sensing device 63 located behind the rolls 8, 8' the sensor 66 of the device 63 causes the stop member 65 to retract and causes the rolls 8, 8' to close. The bar 1 advances further through the rolls 8, 8' and as the trailing end of the bar leaves the sensing device 62, the rolls 8, 8' are caused by the sensor of the device 62 to open. The sensing devices 62, 63 are adjustable in the direction of the path of the bar 1 and hence the section of the bar which is extruded can be varied by forward and rearward adjustment of the sensing devices 62, 63.

The driven rollers 25, 27, 29 serve to advance the bar 1 along its path through the apparatus 6. To maintain pressure between opposing sets of driven rollers 25, 27, 29, pneumatic heads 55 are provided which carry the upper rollers in the sets. Each head 55 has a dependant rod 56 which connects to a mounting 57 which carries the associated roller and which is slidable in a guide 58 (FIG. 6*b*).

As the bar passes between the straightening rollers 26 it is straightened in a vertical plane and as it passes between the straightening rollers 28 it is straightened in a horizontal plane. The rollers 28 have central channels 59 formed therein to accommodate the lobes 3 On the bar as it passes between the rollers (FIG. 6*c*).

Each of the straightening rollers 26, 28 is adjustable towards and away from its opposing rollers to enable its effect on the bar 1 to be varied. For this purpose each straightening roller 26, 28 is mounted on a slide 70 which is slidable in a guide 71 and is adjustable by means of a setting bolt 72 (FIG. 6*d*). The slide 70 is secured by lock nuts 73, 74. In a preferred form, the rollers 26, 28 will be so adjusted that a flexing of the bar 1 beyond its elastic limits takes place as it passes between the rollers.

Once the bar 1 has passed through the apparatus 6, the thread 5 is rolled onto the section B of the bar in conventional manner. The minimum diameter i of the bar may be chosen such that the cross-section of the bar at this point approximately equals the minimum cross-section of the bar in the section A thereof.

A chute 75 is positioned beneath the rolls 8, 8' to collect scale generated by the action of the rolls on the bar 1 (FIG. *2a*).

The manner of forming a bar 1 described above is relatively simple and inexpensive and the apparatus 6 can maintain speeds of the bar 1 passing therethrough of at least 35m/min.

In this embodiment of the invention the lobes 3 are formed in a single plane but if desired they can be formed in two or more planes.

In an alternative form, a continuous length of the bar 1 may be fed through the apparatus 6 shown in FIGS. *2a* to *2b*. In such a case the rolls 8, 8' are periodically displaced away from and towards one another to ensure that extrusion takes place only on consecutive selected sections of the bar. Once the bar has passed through the apparatus, it is cut into the required lengths and threads are rolled onto the individual lengths in conventional manner.

In FIGS. *7a* and *7b* two rock bolts made according to the invention are shown. The rock bolt 80 shown in FIG. *7a* is intended for embedding in a resin mixed with a catalyst. It has a thread 5 formed at one end thereof to receive a nut (not shown). At its other end it has a chamfered point 81 which is used to rupture a capsule containing the resin (not shown) located in the hole in the rock matrix in which the bolt is to be embedded.

The rock bolt 82 shown in FIG. *7b* is similar to the one shown in FIG. *7a* but instead of the point 81 it has a thread 83. The thread 83 is used to connect the rock bolt to a conventional mechanical anchor (not shown) which expands when the rock bolt is tensioned to anchor it in a hole. In addition to the mechanical anchor, a resin or concrete can be used to grout the rock bolt 82 in the hole.

In the embodiment of the invention illustrated in FIGS. *3c* and *3d*, a hardened metal insert 85 is located in the groove 12 or 12' of a roll 8 or 8', The insert locates between two pins 14 and is trapped in the rebates 16 in the pins. An insert 85 on the roll 8 periodically aligns with a similar insert on the roll 8' when the rolls are rotated as described above. With this arrangement a pair of opposed notches 86, 86' is formed at regular intervals along the length of the bar 1. Each pair of notches 86, 86' serves as a zone of weakness where the bar will sever upon the application of a predetermined axial or lateral force upon the bar.

The opposed notches 86, 86' are made to such a depth that the bar 1 will have sufficient tensile strength to serve as an anchor bolt. In the case of coal mining, the anchor bolt will have a tensile strength of 4 to 5 tonne which is sufficient for securing coal walls.

In use the bolts when carrying notches 86, 86' will be used particularly in the side walls of coal workings to secure the walls. When a coal cutter is used to remove coal from the side walls the coal cutter will bring forces, especially lateral forces, to bear on the bolts which will cause them to sever at the notches 86, 86'. The broken bolts will simply end up in the mass of the cut coal. It is considered that the bolts will not damage the coal cutter because of the relative size and hardness of the cutter and of the bolts respectively.

Where an anchor bolt made according to the invention is to be embedded in a resin mixed with a catalyst, the bolt will, in use, be rotated about its axis to assist in mixing of the resin. The lobes 3 on the bolt will in such a case assist considerably in mixing the resin by causing lateral displacement of the resin during rotation of the bolt. In this regard, any particle situated adjacent the bolt between two lobes 3 will be displaced by the lobe on the opposite side of the bolt when it is rotated. The improved mixing ability of the bolt arises from the fact that with the use of the lobes 3, the diameter of the bolt at the apices of opposed lobes can be as much as 1,5 times the diameter of the bolt. It will also be appreciated that the bolt described above provides a continuously changing perimeter along its length and this in itself enhances its mixing ability in use. The lobes 3 will also assist in the anchoring of the bolt in settable material.

Apart from the mixing ability of the bolt of the invention, its lateral lobes 3 and longitudinal grooves 2 with lands 4 provide it with an exceptionally high anchoring ability in a resin or other matrix.

With the method of making an anchor bolt in accordance with the invention the machining or shaving step in the prior art method described above, is also dispensed with.

In addition, a substantial saving of material can be obtained with an anchor bolt made according to the invention, when regard is had to the following.

The diameter of the ribbed section of the prior art rock bolt is larger than the diameter (e) thereof. Yet this larger diameter does not increase the tensile strength of the prior art bolt, since the tensile strength is determined by the minimum diameter of the thread (f). The prior art rock bolt therefore carries excess material over the length of its ribbed section.

In the rock bolt made according to the invention, there is no excess material since the minimum cross-section of the bar in the section A thereof equals the cross-section at the minimum diameter i of the thread 5. In addition, with the extrusion of the section A of the bar 1 an increase in overall length of the bar 1 is obtained. One therefore starts with a shorter bar than is required and after extrusion the bar is of the required length. In this way an overall saving of material in excess of 20% can be achieved compared with a prior art rock bolt, which results in a less expensive rock bolt when made according to the method of the invention. In practice the reduction in cross-section of the bar over the section A thereof can be in the region of 10%. The increase in length of the bar which is achieved can be in the order of 10%.

It will be appreciated that the saving of material with the rock bolt of the invention does not result in a loss of tensile strength, since the cross-section of the rock bolt is nowhere less than that at the minimum diameter i of the thread 5. Moreover, the extrusion process serves to work harden the rock bolt to increase its strength.

It is well known that the load capacity of the anchorage provided by a rock bolt embedded in a settable material such as concrete is proportional to the perimeter of the bolt. To ensure that a rock bolt according to the invention does not have a lesser anchorage capacity compared with a conventional rock bolt, the perimeter of the bar 1 may be increased during or after the extrusion operation. This is done, for example, by changing the cross-section of the bar in the extrusion operation from a circular to a different shape, as shown in FIG. *1d*.

Thus, the rock bolt of the invention formed in this way from a bar of smaller cross-section than that of a conventional rock bolt, can provide the same anchorage capacity as the conventional rock bolt.

The rock bolt of the invention can also be made from pipe or metal bar with an axial bore, for use in applications where settable material is injected through the rock bolt itself. Also, any part of the rock bolt of the invention may be left free of lobes 3, if required.

The invention has particular application to rock bolts which are provided in lengths in which the lobed section is longer than 1 meter.

Other embodiments of the invention may be made without departing from the scope of the invention as defined in the appended claims.

We claim:

1. A method of making an anchor bolt with a thread on a section thereof comprising the steps of sequentially providing a metal bar of circular or near circular cross-section having a predetermined diameter, extruding the bar along a selected section thereof to reduce its cross-section, forming a series of lateral protrusions on the selected section of the bar, straightening the bar, and, forming an uninterrupted circular thread on a further selected and unextruded section of the bar and which circular thread has a pitch diameter corresponding to said predetermined diameter, the root of the thread defining a cross-section of the bar substantially equal to said reduced cross-section whereby the tensile strength of said bolt is determined by the equal cross-sections of said root and reduced selected section.

2. A method as claimed in claim 1 including, during extrusion, indenting the bar by forming a longitudinal groove therein.

3. A method as claimed in claim 1 including, during extrusion, indenting the bar by forming a pair of longitudinal grooves along diametrically opposed sides of said bar.

4. A method as claimed in claim 1 wherein the steps of extruding the bar and forming lateral protrusions thereon is effected simultaneously by passing the bar between a pair of rolls in a cold condition of the bar.

5. A method as claimed in claim 4, including forming at least one zone of weakness in the bar as the bar passes between the rolls whereby the bar will first sever upon the application of a predetermined axial or lateral force upon the bar.

6. A method according to claim 1 wherein the step of forming a thread includes cold rolling the further selected and unextruded section of the bar.

7. A method according to claim 1 including extruding the bar along said selected section to a cross-section substantially equal to the cross-section of the threaded, unextruded section at the roots of the threads.

8. A method according to claim 7 wherein the step of forming a thread includes cold rolling the further selected and unextruded section of the bar.

* * * * *